US006547375B2

(12) United States Patent
Isono et al.

(10) Patent No.: US 6,547,375 B2
(45) Date of Patent: Apr. 15, 2003

(54) INK-JET HEAD AND MANUFACTURING METHOD THEREOF

(75) Inventors: Hitoshi Isono, Tenri (JP); Yoshinori Nakajima, Joyo (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/055,288

(22) Filed: Jan. 23, 2002

(65) Prior Publication Data

US 2002/0097304 A1 Jul. 25, 2002

(30) Foreign Application Priority Data

Jan. 23, 2001 (JP) ..... 2001-014699

(51) Int. Cl.[7] ..... B41J 2/45
(52) U.S. Cl. ..... 347/69
(58) Field of Search ..... 347/68, 69, 70, 347/71; 310/333; 29/890.1

(56) References Cited

U.S. PATENT DOCUMENTS 5,646,661 A * 7/1997 Asai et al. ..... 347/69
5,666,144 A * 9/1997 Zhang ..... 347/69
5,680,163 A * 10/1997 Sugahara ..... 347/17
5,754,203 A * 5/1998 Kinoshita ..... 347/69
6,070,310 A * 6/2000 Ito et al. ..... 623/17.11

FOREIGN PATENT DOCUMENTS

JP 11-115196 4/1999

* cited by examiner

*Primary Examiner*—Judy Nguyen
(74) *Attorney, Agent, or Firm*—Dike, Bronstein, Roberts & Cushman; David G. Conlin; David A. Tucker

(57) ABSTRACT

An ink-jet head includes an electrode formed to continue from an inner surface in an ink chamber to a back end surface of a diaphragm through an inclined surface of the diaphragm. The inclined surface forms an angle greater than 90° with the inner surface in the ink chamber and forms an angle greater than 90° with the back end surface of the diaphragm. The electrode thus has a sufficient thickness on the corner portion formed by the inner surface in the ink chamber and the back end surface of the diaphragm. Accordingly, even if any component touches or hits the corner portion formed by the inner surface and the back end surface, in an assembly process of the ink-jet head, the electrode is prevented from being cut off and thus from being broken. In this way, the electrode can surely be connected electrically to a driving circuit.

2 Claims, 6 Drawing Sheets

INK-JET HEAD AND MANUFACTURING METHOD THEREOF

BACKGROUND OF THE INVENTION

1. Field of the Invention

The present invention relates to an ink-jet head and a method of manufacturing the ink-jet head. The ink-jet head has an electrode formed on an inner surface of a diaphragm in an ink chamber, and a drive voltage is applied to the electrode according to image data to cause shear deformation of the diaphragm and accordingly cause a pressure change within the ink chamber. Ink drops are thus selectively ejected from respective ink chambers.

2. Description of the Background Art

Nonimpact printers such as ink-jet printer are appropriate for color printing and increasing number of gray-scale levels, and the nonimpact printers replacing impact printers have rapidly been widespread in recent years. A nonimpact printer of drop-on-demand type employs Kaiser method using a piezoelectric element or employs thermal jet method using a heating element for ejecting required ink only when a print is made. This drop-on-demand type printer is advantageous particularly in printing efficiency, production cost and running cost for example, and thus is in the mainstream of the nonimpact printers.

According to the Kaiser method, the volume of the piezoelectric element outside an ink chamber changes to deform a part of a wall forming the ink chamber so that ink is ejected therefrom. This Kaiser printer is difficult to decrease in size and inappropriate for enhancement of resolution. According to the thermal jet method, heating of the heating element causes air bubbles in the ink contained in an ink chamber and the pressure of the air bubbles causes ink to be ejected. The ink is repeatedly subjected to heating and cooling and thus the ink must have a high endurance, and the heating element has a short lifetime and a high power consumption.

In order to overcome these disadvantages, an ink-jet printer utilizes shear deformation of piezoelectric material forming an ink chamber, the shear deformation resulting in a change in pressure of ink within the ink chamber, and accordingly ink is ejected. In this type of ink-jet printer, a plurality of groove-shaped ink chambers partitioned by diaphragms are formed on a substrate of piezoelectric material, and a drive voltage is applied to an electrode formed on an inner surface of the diaphragm in the ink chamber to cause shear mode deformation of the diaphragm of piezoelectric material. Then, the pressure of ink which fills the ink chamber changes to eject ink drops from the ink chamber. The ink-jet printer of this type is suitable for increase in the density of nozzles, decrease of power consumption and higher frequency of the drive voltage.

Referring to FIGS. 6 and 7, a conventional ink-jet head formed of piezoelectric material includes a plurality of groove-shaped ink chambers 104 partitioned by diaphragms 103 that are formed on the upper surface of a substrate 101 of piezoelectric material which is polarized in the direction of thickness. The ink-jet head further includes a cover plate 102 where an ink supply opening 121 and a common ink chamber 122 to be placed on the upper surface of ink chambers 104, and a nozzle plate 109 where a nozzle 110 communicating with the front side of each ink chamber 104 is formed. Cover plate 102 and nozzle plate 109 are attached to substrate 101. An electrode 105 is formed on an upper half of the inner surface, in the direction of depth, of each diaphragm 103 in ink chamber 104.

Ink chamber 104 includes a shallow-groove region 106 on the back side of region A of a constant depth with region B therebetween. The bottom surface in the cross section of region B is in the shape of arc corresponding to the diameter of a dicing blade used for dicing for forming ink chamber 104 on substrate 101. Shallow-groove region 106 is used as a region for connecting the electrode electrically to an external driving circuit. An electrode 108 of a flexible substrate for example has one end connected to the external driving circuit, and the other end thereof is connected to electrode 105 formed on shallow-groove region 106 via a bonding wire or anisotropic conductive film (ACF).

In the conventional ink-jet head shown in FIGS. 6 and 7, the cross sectional bottom surface of ink chamber 104 in region B is in the shape of arc. In region B communicating with common ink chamber 122, the upper surfaces of diaphragms 103 are not joined to cover plate 102. Therefore, even if a drive voltage is applied to electrode 105, no shear deformation occurs in diaphragms 103 in region B and accordingly no pressure for ejecting ink is generated. In other words, region B is an unnecessary part which does not contribute to the essential ink-ejecting function. Rather, region B impedes shear deformation of diaphragms 103 in region A.

Formation of electrode 105 is also necessary in region B. Then, the capacitance of electrode 105 increases, which causes delay in rise and fall of a drive voltage and accordingly results in increase of power consumption. In addition, the length of region B in the direction from the front side to the back side of substrate 101 is determined depending on the diameter of the dicing blade used for dicing and on the depth of ink chamber 104. For example, if the dicing blade of 52 mm in diameter is used for forming ink chamber 104 of 360 $\mu$m in depth, the length of region B is approximately 4.3 mm which is equal to or greater than the length of region A. Then, the material cost increases due to the increased area of substrate 101.

In order to eliminate the region in the ink chamber that is unnecessary for generation of pressure by which ink is ejected, an ink-jet head structure is proposed according to which the ink chamber has a constant depth over the entire length in the direction from the front to the back side of the substrate. Referring to FIG. 8 which is an exploded perspective view of such a structure viewed from the back side thereof, a cover plate 202 has no ink supply opening and no common ink chamber. Instead, a manifold 260 has an ink supply opening 261 and a common ink chamber 262 formed therein and is joined to the back side of a substrate 201. An electrode 205 is formed on an inner surface of each diaphragm 203 in an ink chamber 204. Respective electrodes 205 of ink chambers 204 are separately formed and continue to the back side of substrate 201 where the back end surfaces of diaphragms 203 are located. On the back side of substrate 201, electrodes 205 are electrically connected to an external driving circuit.

In this conventional ink-jet head, from which eliminated the region of the ink chamber that is unnecessary for generation of pressure causing ejection of ink, the electrodes are formed from the inner surfaces of diaphragms to the back surface of the substrate, the back surface being orthogonal to the inner surfaces. Therefore, it is likely that the electrode has an insufficient thickness at the right-angled corner where the inner surface of the diaphragm and the back surface of the substrate meet. When the ink-jet head is assembled, the electrode at the corner is readily separated by being touched or hit with another component. Consequently, the electrode is broken and no shear deformation can be caused in the diaphragm even if a drive voltage is applied thereto. A resultant problem is accordingly that ink cannot correctly be ejected.

SUMMARY OF THE INVENTION

One object of the present invention is to provide an ink-jet head and a manufacturing method thereof, the ink-jet head eliminating any region in an ink chamber that is unnecessary for generation of pressure which causes ink ejection while surely preventing an electrode from being broken, and being able to correctly ejecting ink according to a drive voltage.

The present invention is structured as detailed below for achieving the object above.

(1) According to the present invention, an ink-jet head includes a substrate of piezoelectric material and a plurality of groove-shaped ink chambers each having respective ends in the longitudinal direction that open respectively at front and back end surfaces of the substrate, the ink chambers being partitioned by diaphragms respectively and formed on an upper surface of the substrate, and the ink-jet head further includes an actuator portion having an electrode formed on an inner surface of each of paired diaphragms facing each other in each ink chamber, the electrode continuing to the back end surface of the substrate. Each diaphragm has a surface which forms an obtuse angle with the inner surface of the diaphragm in the ink chamber and forms an obtuse angle with a back end surface of the diaphragm, and the surface of the diaphragm is formed, in the direction of depth of the ink chamber, in a range including at least a region where the electrode is formed.

In this structure of the ink-jet head, the inner surface of each diaphragm in the ink chamber and the back end surface of the diaphragm are continuously formed through the surface which meets the inner surface with an obtuse angle therebetween and meets the back end surface with an obtuse angle therebetween, and the electrode is formed continuously on these surfaces. Accordingly, the electrode continues from the inner surface in the ink chamber to the back end surface of the diaphragm through the corner portion with angles greater than 90°. Then, the electrode has a sufficient thickness on the corner portion and is never readily broken even if being touched or hit with any component.

The surface of the diaphragm, which forms an angle greater than 90° with the inner surface and forms an angle greater than 90° with the back end surface, is formed in the direction of depth of the ink chamber in a range including at least a region where the electrode is formed. Accordingly, the inner surface and the back end surface continue to at least a part of the surface in the direction of depth of ink chamber, the surface forming an angle greater than 90° with each of the inner surface and back end surface of the diaphragm. Therefore, the electrode has a sufficient thickness on the corner portion and is never readily broken even if being touched or hit with any component.

(2) The electrode on the back end surface of the substrate is divided into respective separate sections for respective ink chambers.

According to this structure, the electrode formed on the back end surface of the substrate is divided into respective sections for respective ink chambers. A drive voltage is thus applied individually to each of the electrode sections formed for respective ink chambers so that an image is formed with a resolution according to the intervals between the ink chambers.

(3) In the structure described in section (1) or (2), the electrode on the back end surface of the substrate can electrically be connected to an external driving circuit.

According to this structure, the minimum distance is achieved between the electrode on the inner surface in the ink chamber and a position where the electrode is connected to the external driving circuit. The capacitance of the electrode can thus be made minimum to reduce power consumption.

(4) A method of manufacturing an ink-jet head includes a grooving step for forming, on an upper surface of a substrate of piezoelectric material, a plurality of groove-shaped ink chambers each having respective ends in the longitudinal direction that open respectively at front and back end surfaces of the substrate, the ink chambers being partitioned by diaphragms respectively, and an electrode forming step for forming an electrode on an inner surface of each of paired diaphragms facing each other in each ink chamber, the electrode continuing to the back end surface of the substrate. The method further includes a surface processing step for forming, prior to the electrode forming step, a surface of the diaphragm that forms an obtuse angle with the inner surface of the diaphragm in the ink chamber and forms an obtuse angle with a back end surface of the diaphragm, the surface of the diaphragm being formed, in the direction of depth of the ink chamber, in a range including at least a region where the electrode is formed.

According to this method, after formation of the surface which forms an obtuse angle with the inner surface of the diaphragm in the ink chamber and forms an obtuse angle with the back end surface of the diaphragm, the electrode is formed to continue from the inner surface to the back end surface. Accordingly, the electrode continues from the inner surface in the ink chamber to the back end surface of the diaphragm through the corner portion with angles greater than 90°. Then, the electrode has a sufficient thickness on the corner portion and is never readily broken even if being touched or hit with any component.

The surface of the diaphragm, which forms an obtuse angle with the inner surface and forms an obtuse angle with the back end surface, is formed in the direction of depth of the ink chamber in a range including at least a region where the electrode is formed. Accordingly, the inner surface and the back end surface continue to at least a part of the surface in the direction of depth of ink chamber, the surface forming an angle greater than 90° with each of the inner surface and back end surface of the diaphragm. Therefore, the electrode has a sufficient thickness on the corner portion and is never readily broken even if being touched or hit with any component.

(5) According to the method described in section (4), the electrode may be formed by vapor deposition of a material for the electrode.

According to this method, simultaneously with formation of the electrode on the inner surface in the ink chamber, the electrode is formed on the surface forming an obtuse angle with the inner surface and forming an obtuse angle with the back end surface of the diaphragm as well as on the back end surface of the substrate. Then, the manufacturing process can be simplified and accordingly the manufacturing cost can be reduced.

(6) The surface processing step is carried out prior to the grooving step, and the surface processing step includes the steps of covering an upper surface of the piezoelectric material with a mask member having an opening with a predetermined shape and performing sandblasting from an upper surface of the mask member.

According to this method, after the upper surface of the piezoelectric material, which is covered with the mask member having an opening with a predetermined shape, is sandblasted, the grooving step is performed for forming ink chambers. Then, prior to formation of the ink chambers, the sandblasting surely produces the surface which forms an obtuse angle with the inner surface of the diaphragm in the ink chamber and forms an obtuse angle with the back end surface of the diaphragm.

(7) The surface processing step is carried out after the grooving step for chamfering a corner formed by the inner surface of the diaphragm in the ink chamber and the back end surface of the diaphragm.

According to this method, after the grooving step for forming ink chambers, the corner formed by the inner surface and the back end surface of the diaphragm is chamfered. Then, after formation of the ink chambers, a cutting process such as milling is performed to surely produce the surface which forms an obtuse angle with the inner surface of the diaphragm in the ink chamber and forms an obtuse angle with the back end surface of the diaphragm.

(8) The method further includes the step of forming a mask member, prior to the electrode forming step, for dividing a back end surface of the diaphragms into respective separate sections for respective ink chambers.

According to this method, the back end surface of the diaphragms is divided into respective sections for respective ink chambers by the mask member before the electrode forming step. Then, after the electrode forming step, respective sections of the electrode for respective ink chambers are formed on the back end surface of the diaphragms. Therefore, no breakage of diaphragms occurs, the breakage being caused by any process distortion when the electrode is mechanically removed partially. Consequently, the yield is improved.

(9) The method further includes the step of removing, after the electrode forming step, a part of the electrode formed on the back end surface of the substrate to divide the electrode into respective separate sections for respective ink chambers.

According to this method, the electrode formed on the back end surface of the substrate in the electrode forming step is partially removed and accordingly divided into respective sections for respective ink chambers. In this way, the electrode formed on the back end surface of the substrate is separated at accurate positions and each ink chamber thus has uniform electrical characteristics maintained therein.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
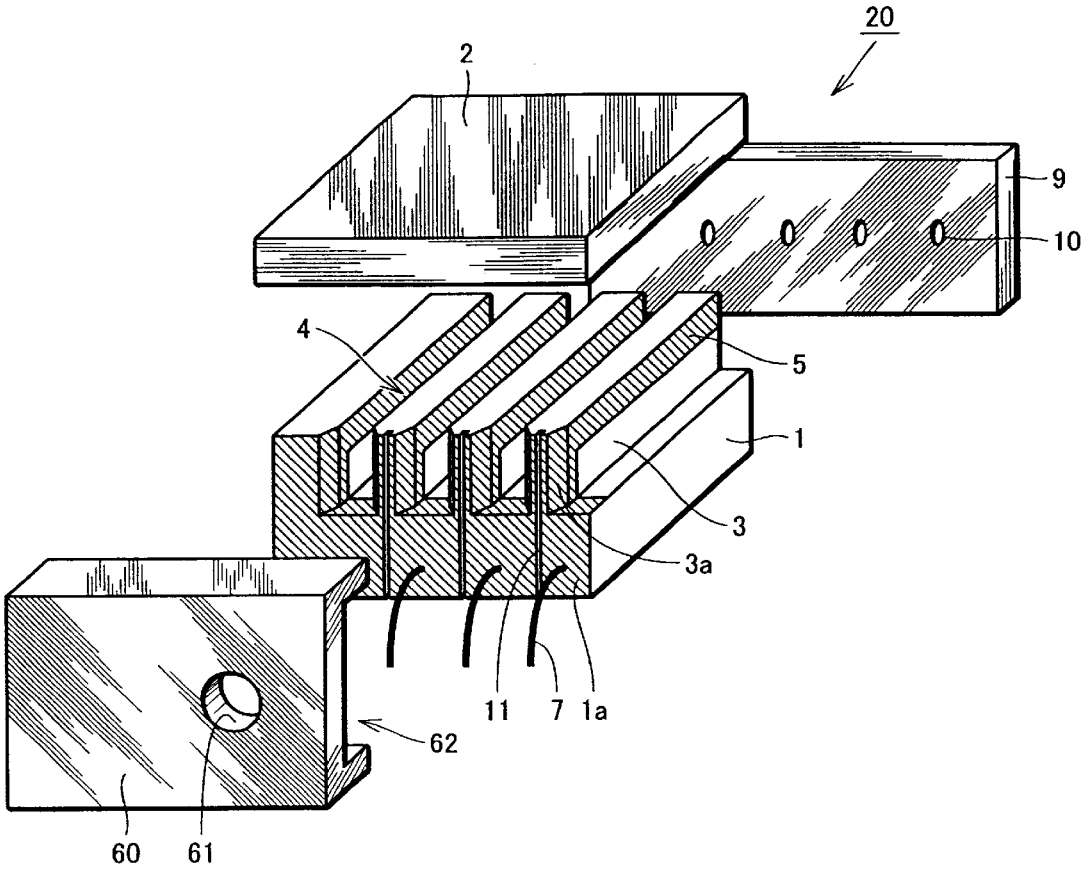
FIG. 1 shows a structure of an ink-jet head, viewed from the back side thereof, according to a first embodiment of the present invention.
Figure 2:
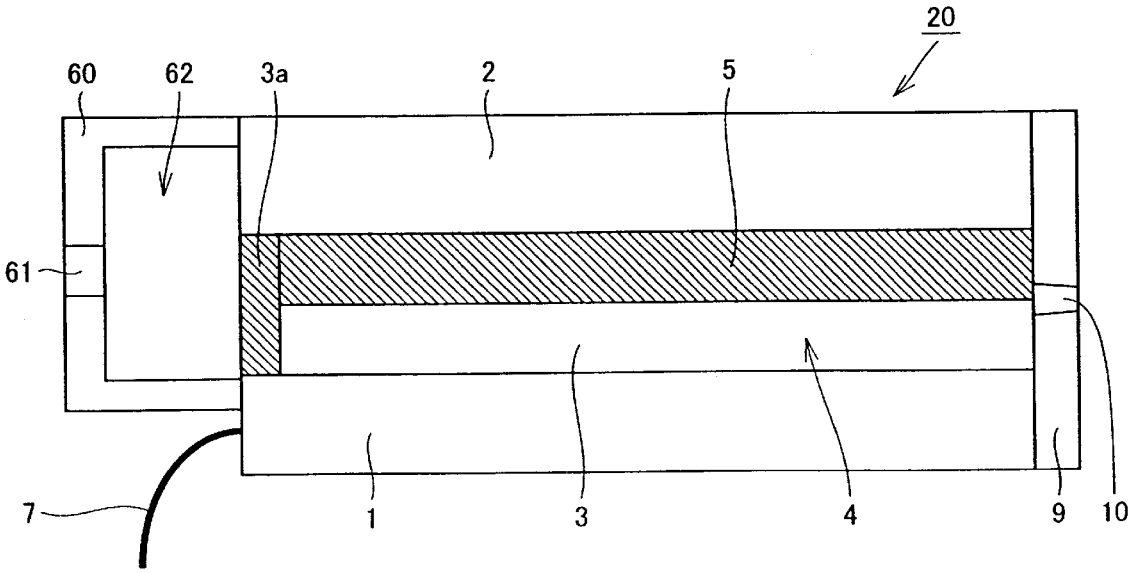
FIG. 2 is a side cross sectional view of the ink-jet head.
Figure 3:
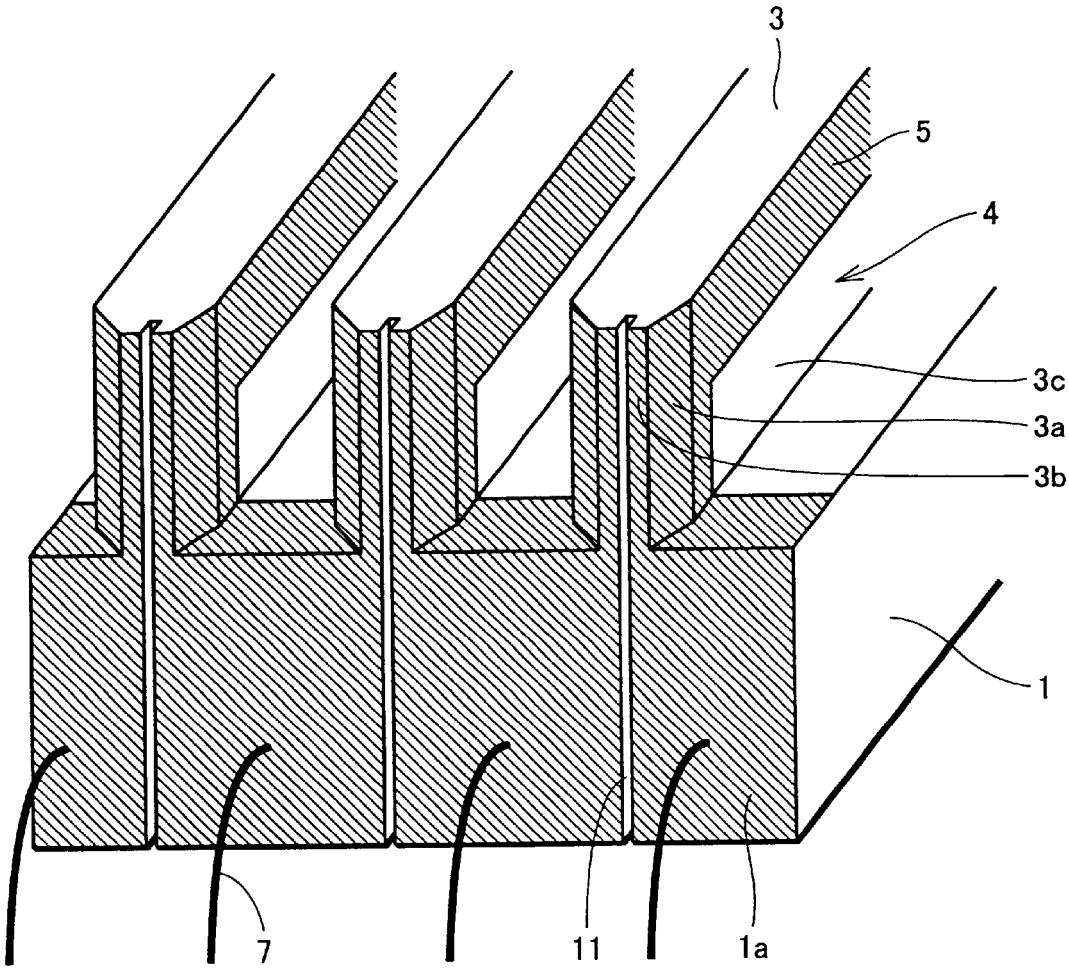
FIG. 3 is a partially enlarged view of a back end surface of a substrate constituting the ink-jet head.

FIG. 1 shows a structure of an ink-jet head, viewed from the back side thereof, according to a first embodiment of the present invention. FIG. 2 is a side cross sectional view of the ink-jet head shown in FIG. 1. FIG. 3 is a partially enlarged view of the back end surface of a substrate constituting the ink-jet head. Ink-jet head 20 according to the first embodiment includes a substrate 1 made of piezoelectric material where a plurality of groove-shaped ink chambers 4 partitioned by diaphragms 3 are formed, a cover plate 2 is joined to the upper surface of substrate 1, a nozzle plate 9 is joined to the front surface of substrate 1, and a manifold 60 is joined to the back surface of substrate 1. A nozzle hole 10 communicating with the front end portion of each ink chamber 4 is formed in nozzle plate 9, and an ink supply opening 61 and a common ink chamber 62 are formed in manifold 60.

As shown in FIG. 2, ink chambers 4 formed on substrate 1 have a constant depth of 300 $\mu$m for example over the entire distance in the longitudinal direction. For example, ink chamber 4 is 70 $\mu$m in width and 1.1 mm in length, and the pitch between ink chambers 4 is 141 $\mu$m. Diaphragm 3 has an inclined surface 3*a* formed on the back end portion of diaphragm 3. Diaphragm 3 also has an inner surface 3*c* in ink chamber 4 and a metal film serving as an electrode 5 is formed on the upper half, in the depth direction of ink chamber 4, of inner surface 3*c*. Electrode 5 continues to a back end surface 1*a* of substrate 1 through inclined surface 3*a*.

As shown in FIG. 3, a corner of diaphragm 3 on the back end portion thereof, where inner surface 3*c* and a back end surface 3*b* of diaphragm 3 meet, is chipped off to form inclined surface 3*a*. The angle formed by inner surface 3*c* in ink chamber 4 and inclined surface 3*a* and the angle formed by back end surface 3*b* of diaphragm 3 and inclined surface 3*a* are each larger than 90°. For example, inclined surface 3*a* is 28 $\mu$m in width, and the angle formed by inner surface 3*c* and inclined surface 3*a* and the angle formed by back end surface 3*b* and inclined surface 3*a* are each 135°.

Electrode 5 is formed to continue from inner surface 3*c* in ink chamber 4 to back end surface 1*a* of substrate 1 that includes back end surface 3*b* of diaphragm 3. Electrode 5 is formed for example by vapor deposition of Al, and has a thickness of 1 $\mu$m on inner surface 3*c* in ink chamber 4 and inclined surface 3*a* and a thickness of 2 $\mu$m on back end surface 1*a* of substrate 1 that includes back end surface 3*b* of diaphragm 3. Electrode 5 may be made of a conductive material other than Al such as Cu, Ni and Ti.

On back end surface 1*a* of substrate 1, a groove 11 of 20 $\mu$m in width and 5 $\mu$m in depth is formed at the central part of the width of diaphragm 3 in the direction in which ink chambers 4 are arranged. By grooves 11, electrode 5 is divided on back end surface 1*a* of substrate 1 into respective separate sections for respective ink chambers 4. On back end surface 1*a* of substrate 1, the sections of electrode 5 respectively for ink chambers 4 are each connected electrically via a bonding wire 7 to an external driving circuit. Grooves 11 are formed by dicing for example.

In this structure of the ink-jet head described above, electrode 5 is formed to continue from inner surface 3*c* in ink chamber 4 to back end surface 3*b* of diaphragm 3 through inclined surface 3*a* forming an angle greater than 90° together with each of inner surface 3*c* in ink chamber 4 and back end surface 3*b* of diaphragm 3. Therefore, electrode 5 has a sufficient thickness on the corner portion between inner surface 3*c* in ink chamber 4 and back end surface 3*b* of diaphragm 3. Then, even if any component touches or hits the corner portion between inner surface 3*c* in ink chamber 4 and back end surface 3*b* of diaphragm 3 in an assembly process of ink-jet head 20, electrode 5 on this portion is never cut off and thus electrode 5 is not broken. In this way, it is possible to ensure electrical connection between electrode 5 and the driving circuit.

Moreover, the surface where electrode 5 is formed for connection with the external driving circuit is different from the surface of substrate 1 to which nozzle plate 9 is joined, and accordingly no groove 11 is formed on the surface of substrate 1 to which nozzle plate 9 is joined. A sufficient area for joining nozzle plate 9 can thus be secured to enhance the joint strength of nozzle plate 9.

Further, it is unnecessary to make groove 11, which divides electrode 5, excessively deeper relative to the thickness of electrode 5, since back end surface 3*b* of diaphragm 3 is coplanar with back end surface 1*a* of substrate 1. Groove 11 can thus be processed easily and no considerable deterioration occurs in the rigidity of diaphragm 3 or substrate 1.

Figure 4:
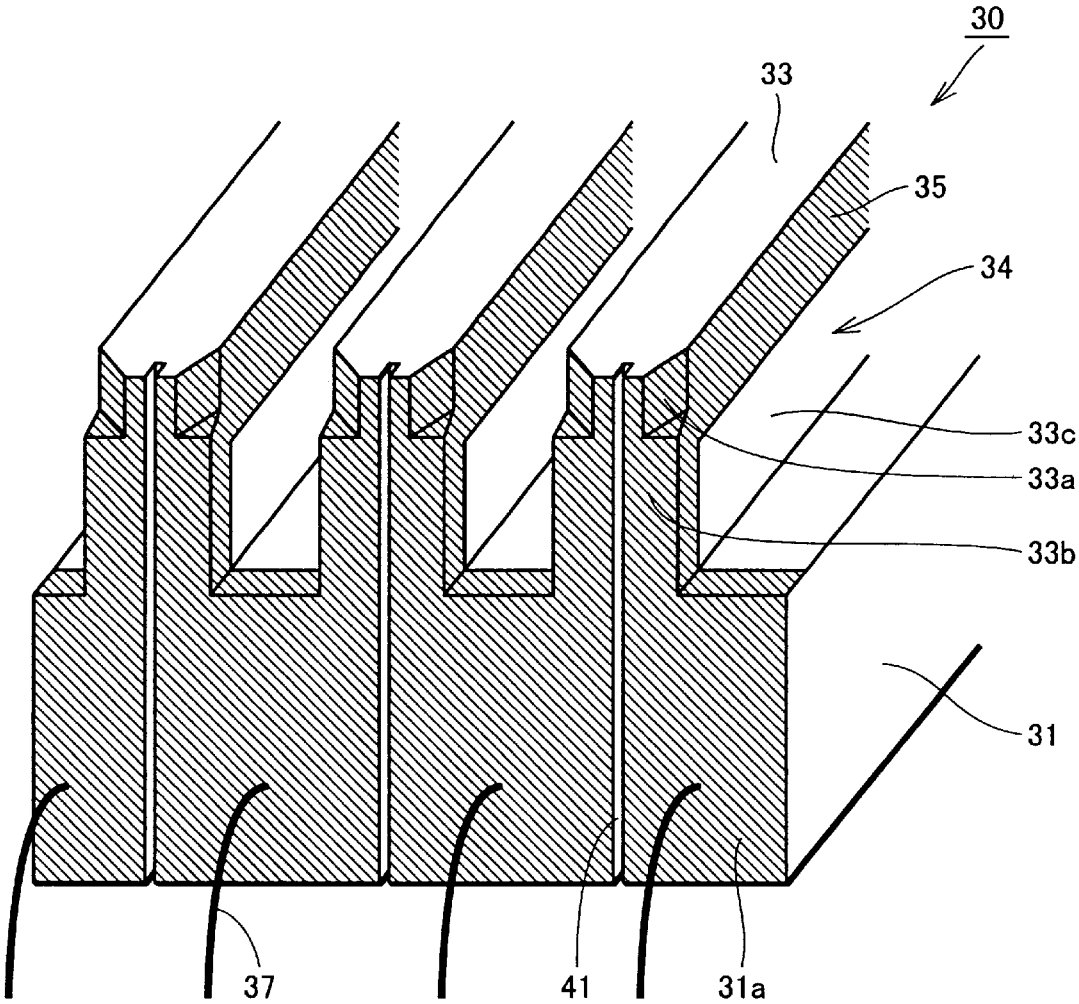
FIG. 4 is a partially enlarged view of a substrate constituting an ink-jet head according to a second embodiment of the present invention, viewed from the back side.

FIG. 4 is a partially enlarged view of a substrate constituting an ink-jet head according to a second embodiment of the present invention, viewed from the back side. Ink-jet head 30 according to the second embodiment includes a substrate 31 having a right-angled corner formed between an inner surface 33*c* of a diaphragm 33 in an ink chamber 34 and a back end surface 33*b* of diaphragm 33, and a part of the right-angled corner, located on the upper side in the direction of the depth of ink chamber 34, is chipped off to form an inclined surface 33*a*. For example, inclined surface 33*a* is 28 μm in width, and the angle formed by inner surface 33*c* of diaphragm 33 in ink chamber 34 and inclined surface 33*a* and the angle formed by back end surface 33*b* of diaphragm 33 and inclined surface 33*a* are each 135°. Back end surface 33*b* of diaphragm 33 has a width where inclined surface 33*a* is formed that is approximately 30 μm.

An electrode 35 is formed to continue from inner surface 33*c* in ink chamber 34 to back end surface 33*b* of diaphragm 33. On the upper side in the direction of the thickness of substrate 31, electrode 35 continues through inclined surface 33*a* from inner surface 33*c* in ink chamber 34 to a back end surface 31*a* of substrate 31 that includes back end surface 33*b* of diaphragm 33. A groove 41 is formed over the whole thickness of back end surface 31*a* of substrate 31. Grooves 41 divide electrode 35 on back end surface 31*a* of substrate 31 into respective separate sections for respective ink chambers 34. On back end surface 31*a* of substrate 31, the sections of electrode 35 that are respectively for ink chambers 34 are each connected electrically to an external driving circuit via a bonding wire 37.

Electrode 35 and groove 41 of ink-jet head 30 are made of respective materials and formed by respective methods similar to those for electrode 5 and groove 11 of ink-jet head 20.

In this structure as described above, electrode 35 has a sufficient thickness on the corner portion between inner surface 33*c* in ink chamber 34 and back end surface 33*b* of diaphragm 33. Then, even if any component touches or hits the corner portion between inner surface 33*c* in ink chamber 34 and back end surface 33*b* of diaphragm 33 in an assembly process of ink-jet head 30, electrode 35 on this portion is never cut off and thus electrode 35 is not broken. In this way, it is possible to ensure electrical connection between electrode 35 and the driving circuit. Moreover, the corner portion of diaphragm 33 on the back end side thereof is only partially chipped off. Therefore, no considerable deterioration occurs in the rigidity of diaphragm 33. It is possible to cause a great change in the pressure in ink chamber 34 and accordingly eject ink from the ink chamber 34, and power consumption of ink-jet head 30 can be reduced.

Figure 5A:
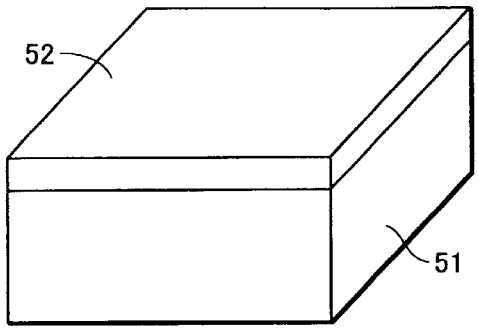
FIGS. 5A to 5F illustrate a method of manufacturing an ink-jet head according to an embodiment of the preset invention.
Figure 5D:
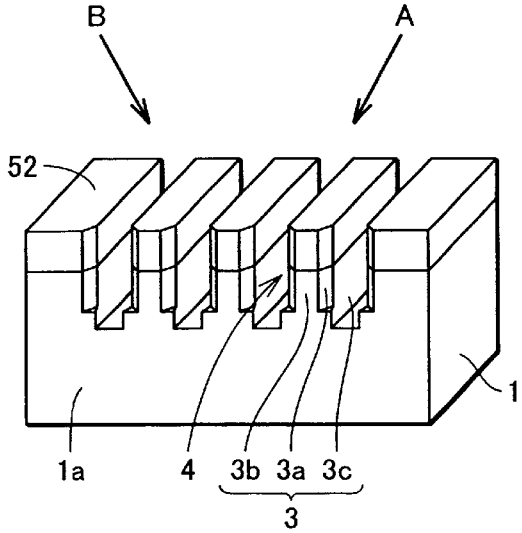
Figure 5B:
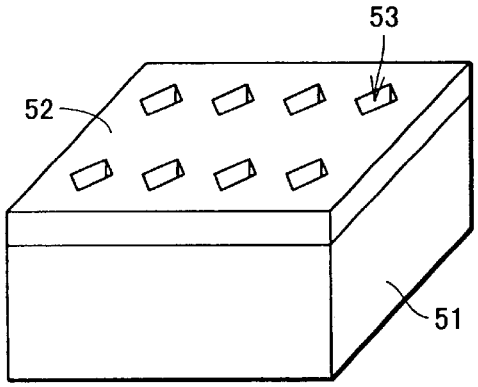

FIGS. 5A to 5F illustrate a method of manufacturing an ink-jet head according to an embodiment of the present invention. Referring to FIG. 5A, according to this method of manufacturing the ink-jet head, on the upper surface of a plate-shaped member 51 made of piezoelectric material such as PZT (lead zirconate titanate) for example that is polarized in the thickness direction, a dry resist film 52 such as Nichigo-ALPHO-NIT625 (manufactured by Nippon Synthetic Chemical Industry Co., Ltd.) for example is formed to a thickness of 30 μm by means of a film laminator. Referring to FIG. 5B, the upper surface of dry resist film 52 is subjected to an exposure process by exposure amount of 400 $mJ/cm^2$ for example via a photomask, and further subjected to a development process for 2 minutes by means of 1 wt % of sodium carbonate. An opening 53 is accordingly formed at a predetermined position.

After this, from the upper surface of dry resist film 52 where opening 53 is formed, sandblasting is performed (and a hole of 200 μm) in depth that faces opening 53 is drilled in plate member 51. Further, dicing of dry resist film 52 and plate member 51 is performed to make a groove in them. For this dicing, a dicing blade is used that has a thickness of 65 μm and a diameter of 52 mm for example and accordingly, grooves with a pitch therebetween of 141 μm and each with a width of 70 μm and a depth of 300 μm are formed. The position of grooves in plate member 51 can be determined based on the position of opening 53.

Figure 5E:
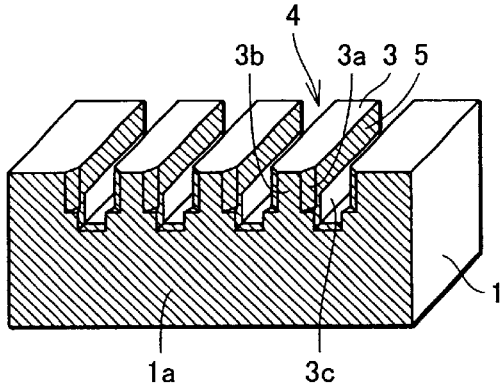
Figure 5C:
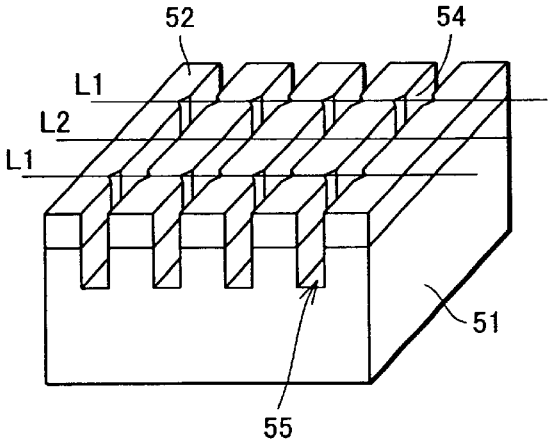

Referring to FIG. 5C, plate member 51 has a plurality of grooves 55 each with a hole 54 in a middle part thereof that are formed by the sandblasting and dicing processes. Plate member 51 is cut, together with dry resist film 52, along a cutting position L1 which is orthogonal to the longitudinal direction of groves 55 and passes through the center of hole 54 and cut along a cutting position L2 which is also orthogonal to the longitudinal direction of grooves 55 and passes through the midpoint between two holes 54. Referring to FIG. 5D, a substrate 1 of a single ink-jet head with the dimension defined by this cutting is accordingly produced in which a plurality of groove-shaped ink chambers 4 partitioned by diaphragms 3 are formed, diaphragm 3 having an inclined surface 3*a* on one end surface side.

Then, on substrate 1 with dry resist film 52 formed thereon, vapor deposition is performed in the oblique directions indicated by arrows A and B in FIG. 5D to form a metal film, serving as an electrode 5, that is made of Al with a thickness of 1.0 μm for example. For this oblique vapor deposition, respective angles of arrows A and B are set so that particles to be deposited are incident on the upper half of an inner surface 3*c* of diaphragm 3 in ink chamber 4 by shadowing effect of dry resist film 52 and the particles to be deposited are simultaneously incident on inclined surface 3*a* and one end surface 3*b* of diaphragm 3 and on one end surface 1*a* of substrate 1. Accordingly, on one end surface 3*b* of diaphragm 3 and one end surface 1*a* of substrate 1, metal particles are incident in both of the directions indicated by arrows A and B to be deposited thereon. The metal film on these surfaces has a thickness of 2.0 μm.

Figure 5F:
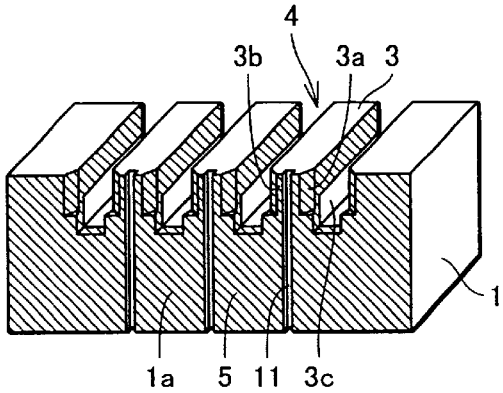
Figure 6:
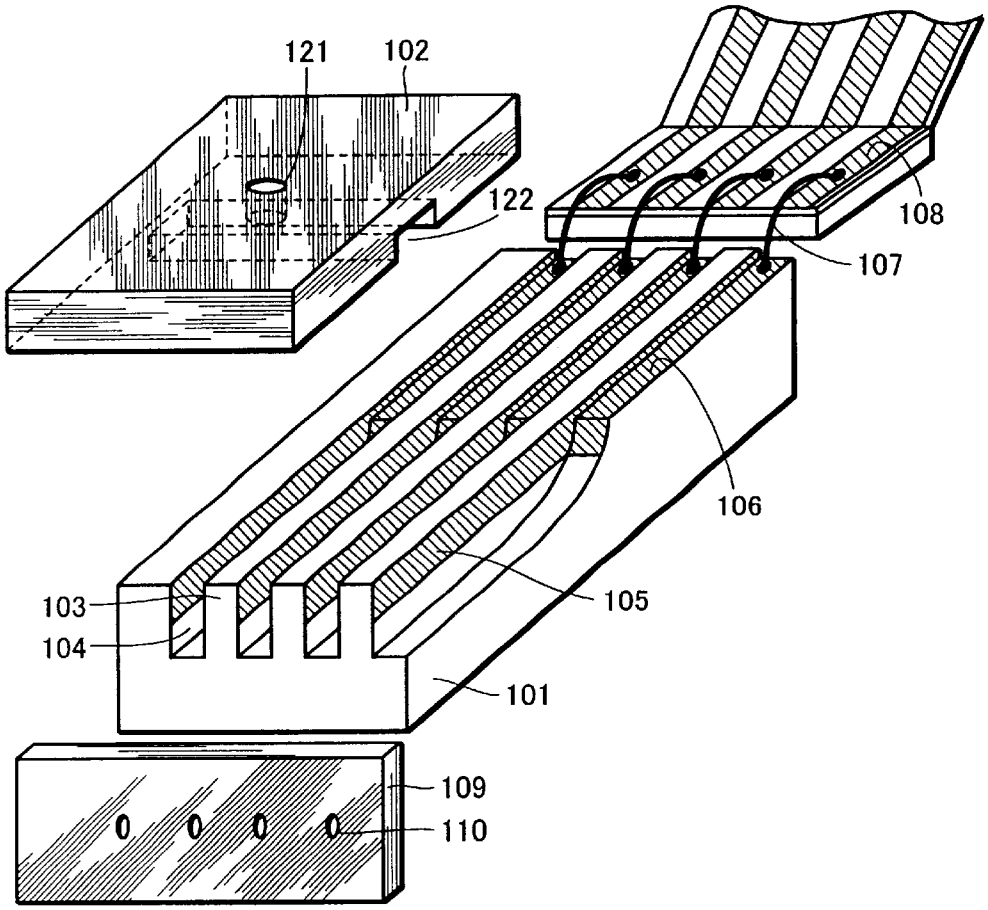
FIG.6 PRIOR ART
FIG. 6 shows a structure of a conventional ink-jet head.
Figure 7:
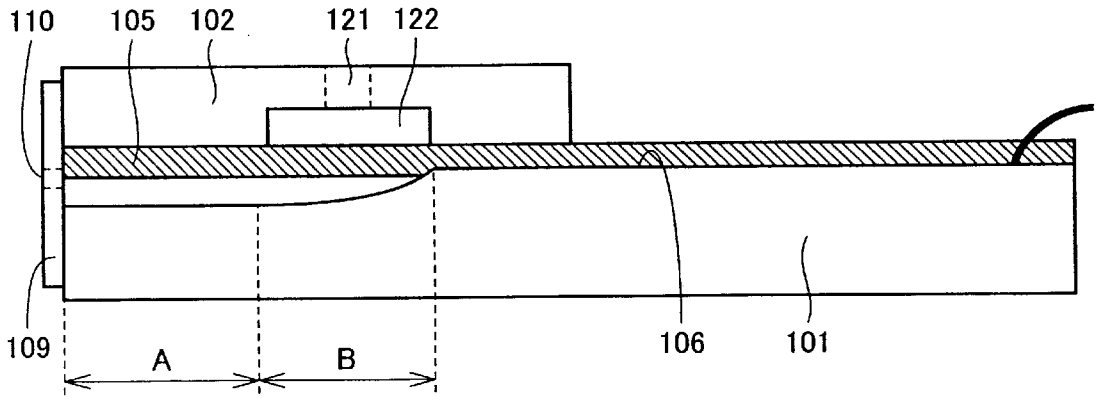
FIG.7 PRIOR ART
FIG. 7 is a side cross sectional view of the conventional ink-jet head.
Figure 8:
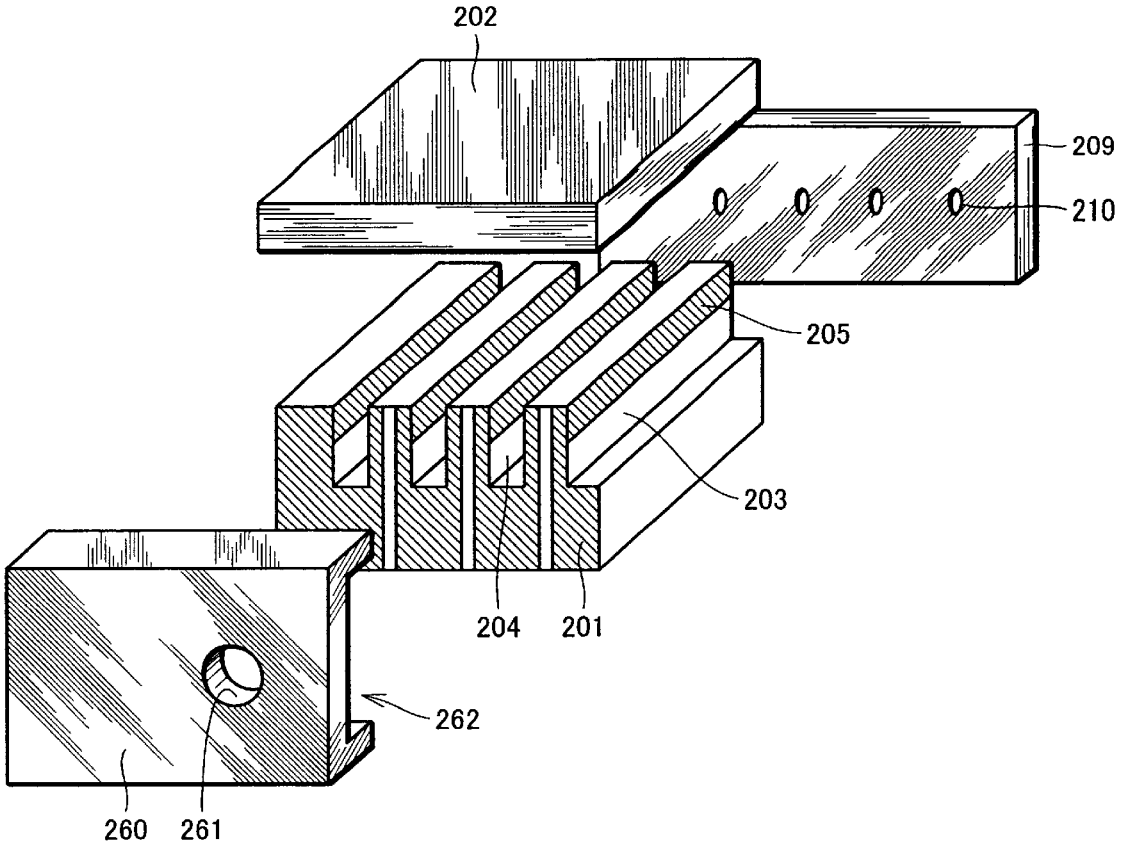
FIG.8 PRIOR ART
FIG. 8 shows a structure of another conventional ink jet head.

In addition, dry resist film 52 together with the metal film formed thereon are lifted off from substrate 1. Referring to FIG. 5E, substrate 1 is accordingly formed that has electrically integrated electrode 5 formed on the upper half of inner surface 3*c* of diaphragm 3 in ink chamber 4, inclined surface 3*a* and one end surface 3*b* of diaphragm 3, and one end surface 1*a* of substrate 1. Then, a groove is formed in one end surface 1*a* of substrate 1 that includes one end surface 3*b* of diaphragm 3, the groove being formed in the direction of thickness of substrate 1. The groove is formed by means of a dicing blade with a thickness of 15 $\mu$m and a diameter of 52 mm for example, the resultant groove being formed in the central part relative to the thickness of diaphragm 3 and having a width of 20 $\mu$m and a depth of 10 $\mu$m. Referring to FIG. 5F, a part of electrode 5 formed on one end surface 1*a* of substrate 1 that includes one end surface 3*b* of diaphragm 3 is removed by groove 11, and thus electrode 5 is surely divided into respective separate sections for respective ink chambers 4.

To the upper surface, the front end surface and the back end surface of substrate 1 where electrode 5 divided into separate sections for respective ink chambers 4 are formed as described above, cover plate 2 covering the upper surface of ink chamber 4, nozzle plate 9 with nozzle holes 10 formed therein and manifold 60 where ink supply opening 61 and common ink chamber 62 are formed as shown in FIG. 1 are joined respectively. An external driving circuit is further connected electrically via a bonding wire 7 to the lower portion of manifold 60 on the back end surface of substrate 1. Accordingly, the ink-jet head is completed.

As heretofore described, according to the method of manufacturing an ink-jet head of this embodiment, inclined surface 3*a* is formed in advance by sandblasting prior to formation of electrode 5. Inclined surface 3*a* meets one end surface 1*a* of substrate 1 (plate member 51) with an angle greater than 90° therebetween and meets inner surface 3*c* in ink chamber 4 with an angle greater than 90° therebetween. Thus, inner surface 3*c* in ink chamber 4 continues to back end surface 1*a* of substrate 1 through inclined surface 3*a* which meets inner surface 3*c* and back end surface 1*a* each with an angle greater than 90° therebetween. Electrode 5 formed on the upper half of inner surface 3*c* in ink chamber 4 continues accordingly to inclined surface 3*a* and further to back end surface 1*a* of substrate 1 with respective obtuse angles therebetween. Therefore, electrode 5 never decreases in thickness on the corner portion and thus is never broken readily.

In addition, the oblique vapor deposition for forming electrode 5 is performed not only on the upper half of inner surface 3*c* of diaphragm 3 in ink chamber 4 but also on inclined surface 3*a* and back end surface 3*b* of diaphragm 3 as well as back end surface 1*a* of substrate 1. The vapor deposition is carried out in the directions with angles set to allow particles to be deposited to be incident simultaneously on these surfaces. In this way, electrode 5 is formed simultaneously from the upper half of inner surface 3*c* in ink chamber 4 through inclined surface 3*a* to back end surface 1*a* of substrate 1. No separate deposition processes are necessary for forming electrode 5 on inclined surface 3*a* and back end surface 1*a*. Consequently, the manufacturing process can be simplified and accordingly the manufacturing cost can be reduced.

Particles of the material for electrode 5 are deposited in two directions on back end surface 1*a* of substrate 1 that is electrically connected to an external driving circuit. Therefore, the electrode on this surface is thicker. Then, connection terminals and electrodes can more firmly be connected electrically to the external driving circuit.

In addition, inclined surface 3*a* is formed by sandblasting a part of substrate 1 that faces opening 53 formed in dry resist film 52. The groove forming ink chamber 4 is made at a position based on the position of opening 53. A surface resultant from cutting on the basis of the position of opening 53 constitutes the back end surface of substrate 1. In this way, inclined surface 3*a* is formed with a high positional accuracy relative to back end surface 3*b* of diaphragm 3 coplanar with back end surface 1*a* of substrate 1 and inner surface 3*c* in ink chamber 4.

After the oblique vapor deposition for forming electrode 5, dry resist film 52 used for sandblasting is lifted off. Thus, dry resist film 52 can be used as a mask for the oblique deposition process, which simplifies the manufacturing process and further reduces the cost.

It is noted that inclined surface 3*a* may be formed by milling instead of sandblasting, and a further reduction of the manufacturing cost is possible by using the milling. In this case, after milling and formation of grooves, the oblique vapor deposition is performed and the metal film on the upper surface of diaphragm 3 is removed by tape polishing or milling. Then, no process for forming the dry resist film is required which further reduces the manufacturing cost.

The present invention provides advantages discussed below.

(1) The inner surface of each diaphragm in the ink chamber and the back end surface of the diaphragm are continuously formed through the surface which meets the inner surface with an obtuse angle therebetween and meets the back end surface with an obtuse angle therebetween, and the electrode is formed continuously on these surfaces. Accordingly, the electrode continues from the inner surface in the ink chamber to the back end surface of the diaphragm through the corner portion with angles greater than 90°. Then, the electrode has a sufficient thickness on the corner portion and is never readily broken even if being touched or hit with any component. Further, the pressure in the ink chamber can surely be changed by shear deformation of the diaphragm that is caused by application of a drive voltage to the electrode, and thus the reproducibility of an image can be improved.

The surface of the diaphragm, that surface forming an obtuse angle with the inner surface and forming an obtuse angle with the back end surface, is formed in the direction of depth of the ink chamber in a range including at least a region where the electrode is formed. Accordingly, the inner surface and the back end surface continue to at least a part of the surface in the direction of depth of ink chamber, the surface forming an angle greater than 90° with each of the inner surface and back end surface of the diaphragm. The diaphragm accordingly has a sufficient strength. Further, the pressure in the ink chamber can surely be changed by shear deformation of the diaphragm that is caused by application of a drive voltage to the electrode, and thus the reproducibility of an image can be improved.

(2) The electrode formed on the back end surface of the substrate is divided into respective sections for respective ink chambers. A drive voltage is thus applied individually to each of the electrode sections formed for respective ink chambers so that an image is formed with a resolution according to the intervals between the ink chambers.

(3) After the surface which meets the inner surface of each diaphragm in the ink chamber with an obtuse angle therebetween and meets the back end surface of the diaphragm with an obtuse angle therebetween is formed, the electrode is formed to continue from the inner surface in the ink chamber to the back end surface of the diaphragm. Accordingly, the electrode can continuously be formed on the inner surface of the diaphragm in the ink chamber and the back end surface of the diaphragm through the corner portion formed by these surfaces with angles of greater than 90°. Then, the electrode has a sufficient thickness on the corner portion and is never readily broken even if being touched or hit with any component. Further, the pressure in the ink chamber can surely be changed by shear deformation of the diaphragm that is caused by application of a drive voltage to the electrode, and thus the reproducibility of an image can be improved.

The surface of the diaphragm, that surface forming an obtuse angle with the inner surface and forming an obtuse angle with the back end surface, is formed in the direction of depth of the ink chamber in a range including at least a region where the electrode is formed. Accordingly, the inner surface and the back end surface continue to at least a part of the surface in the direction of depth of ink chamber, the surface forming an angle greater than 90° with each of the inner surface and back end surface of the diaphragm. The diaphragm accordingly has a sufficient strength. Further, the pressure in the ink chamber can surely be changed by shear deformation of the diaphragm that is caused by application of a drive voltage to the electrode, and thus the reproducibility of an image can be improved.

(4) After the upper surface of the piezoelectric material, which is covered with the mask member having an opening with a predetermined shape, is sandblasted, the grooving step is performed for forming ink chambers. Then, prior to formation of the ink chambers, the sandblasting surely produces the surface which forms an obtuse angle with the inner surface of the diaphragm in the ink chamber and forms an obtuse angle with the back end surface of the diaphragm.

(5) After the grooving step for forming ink chambers, the corner formed by the inner surface and the back end surface of the diaphragm is chamfered. Then, after formation of the ink chambers, the sandblasting surely produces the surface which forms an obtuse angle with the inner surface of the diaphragm in the ink chamber and forms an obtuse angle with the back end surface of the diaphragm.

(6) The back end surface of the diaphragms is divided into respective sections for respective ink chambers by the mask member before the electrode forming step. Then, after the electrode forming step, respective sections of the electrode for respective ink chambers are formed on the back end surface of the diaphragms. Therefore, no breakage of diaphragms occurs, the breakage being caused by any process distortion when the electrode is mechanically removed partially. Consequently, the yield can be improved.

(7) The electrode formed on the back end surface of the substrate in the electrode forming step is partially removed and accordingly divided into respective sections for respective ink chambers. In this way, the electrode formed on the back end surface of the substrate is separated at accurate positions and each ink chamber thus has uniform electrical characteristics maintained therein.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink-jet head comprising a substrate of piezoelectric material and a plurality of groove-shaped ink chambers each having respective ends in the longitudinal direction that open respectively at front and back end surfaces of said substrate, said ink chambers being partitioned by diaphragms respectively and formed on an upper surface of said substrate, and said ink-jet head further comprising an actuator portion having an electrode formed on an inner surface of each of paired diaphragms facing each other in each ink chamber, said electrode continuing to the back end surface of said substrate, each diaphragm having a surface which forms an obtuse angle with the inner surface of the diaphragm in the ink chamber and forms an obtuse angle with a back end surface of the diaphragm, and said surface of the diaphragm being formed, in the direction of depth of said ink chamber, in a range including at least a region where said electrode is formed.

2. The ink-jet head according to claim 1, wherein said electrode on the back end surface of said substrate is divided into respective separate sections for respective ink chambers.

* * * * *